United States Patent [19]

Frazier

[11] Patent Number: 4,672,703

[45] Date of Patent: Jun. 16, 1987

[54] METHOD AND APPARATUS FOR HOLDING AN ELECTRICAL DEVICE PROXIMATE TO A SIDE RAIL OF A BED

[76] Inventor: Clifton L. Frazier, 1213 Selby Ave., St. Paul Park, Minn. 55071

[21] Appl. No.: 752,372

[22] Filed: Jul. 3, 1985

Related U.S. Application Data

[63] Continuation-in-part of Ser. No. 595,309, Mar. 30, 1984, abandoned.

[51] Int. Cl.[4] ..... A47C 21/00; A47B 96/06

[52] U.S. Cl. ..... 5/503; 5/508; 211/13; 211/70.6; 211/119; 248/153; 248/302; 248/314

[58] Field of Search ..... 5/503, 508, 424; 248/302, 314, 214, 153; 211/119, 181, 106, 70.6, 13; 179/146 R

[56] References Cited

U.S. PATENT DOCUMENTS

| | | | |
|---|---|---|---|
| 1,343,363 | 6/1920 | Hall | 211/106 |
| 1,477,702 | 12/1923 | Hall | 248/302 |
| 1,685,277 | 9/1928 | Dryden | 211/181 |
| 2,558,366 | 6/1951 | Madlena | 5/507 |
| 2,562,443 | 7/1951 | Barbour et al. | 248/314 |
| 2,913,740 | 11/1959 | Eldridge . | |
| 3,009,676 | 11/1961 | Buchwald | 248/229 |
| 3,037,214 | 6/1962 | Staiger . | |
| 3,167,287 | 1/1965 | Collins | 211/106 |
| 3,340,826 | 9/1967 | Jenssen, Jr. | 108/49 |
| 3,358,957 | 12/1967 | Lindenmuth | 248/279 |
| 3,586,276 | 6/1971 | O'Mahoney | 5/503 |
| 3,757,363 | 9/1973 | Langlais . | |
| 3,802,657 | 4/1974 | Jackson | 5/503 |
| 4,357,881 | 11/1982 | De Long | 108/49 |
| 4,431,154 | 2/1984 | Hamm | 5/503 |

FOREIGN PATENT DOCUMENTS

| | | | |
|---|---|---|---|
| 228338 | 2/1925 | United Kingdom | 211/106 |

*Primary Examiner*—Alexander Grosz

*Attorney, Agent, or Firm*—Merchant, Gould, Smith, Edell, Welter & Schmidt

[57] ABSTRACT

A method and apparatus (10, 10''') for holding an electrical device proximate to a side rail (20) of a bed (100). The apparatus (10, 10''') preferably includes a first basket (12, 12''') suitable for receiving a television control device (36). The device (36) includes a body (43) and a cord (45). The basket (12, 12''') receives and holds the body (43) of the device (36). Preferably connected to the basket (12, 12''') is another similar basket (14, 14''') for receiving a call button (60). The baskets (12, 12''') and (14, 14''') are connected to rail clips (16, 16''') and (22, 22''') which act to engage the side rail (20) of the bed (100). Another apparatus (10', 10''') is useful for holding an electrical device proximate to the side rail (120) of a circle bed.

6 Claims, 9 Drawing Figures

FIG. 4
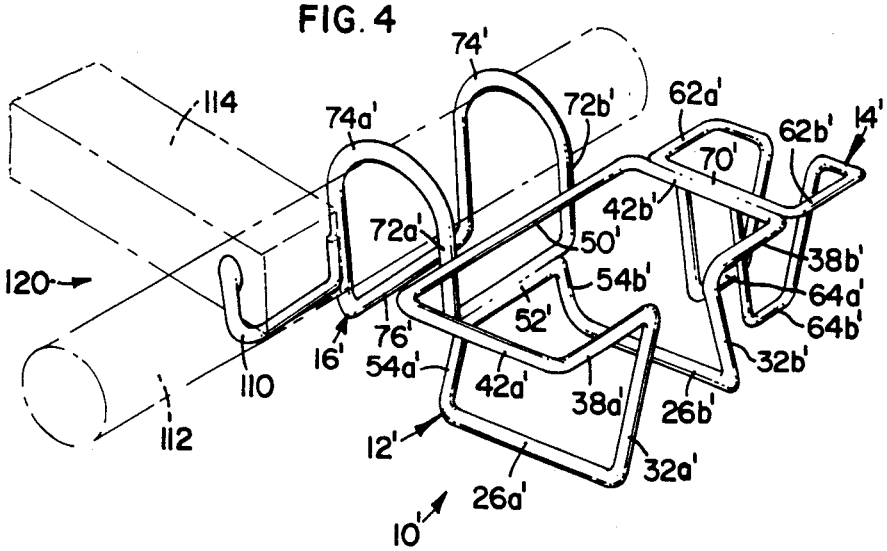
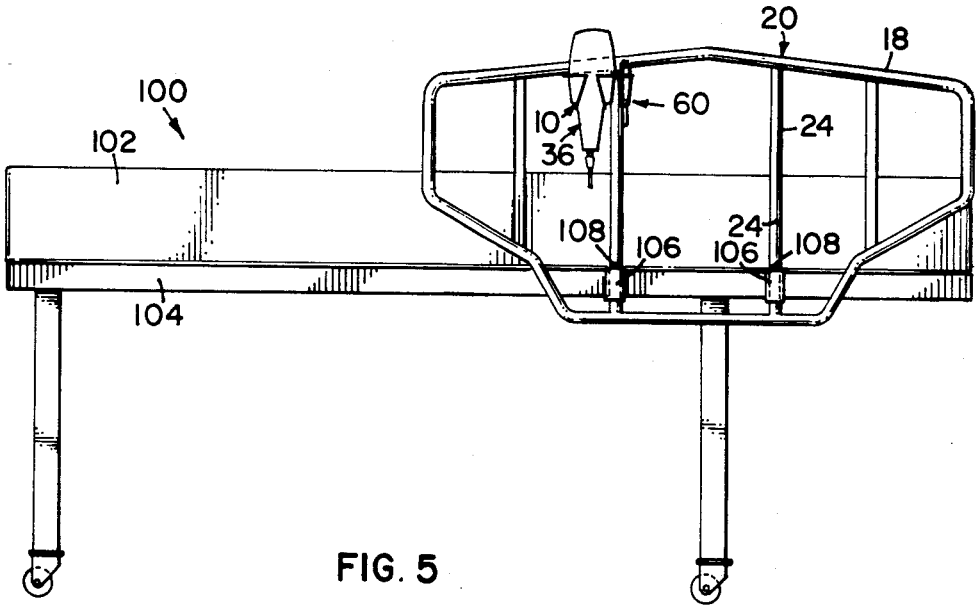
FIG. 5

METHOD AND APPARATUS FOR HOLDING AN ELECTRICAL DEVICE PROXIMATE TO A SIDE RAIL OF A BED

FIELD OF THE INVENTION

This application is a continuation-in-part of application Ser. No. 595,309 filed on Mar. 30, 1984 now abandoned.

The present invention relates generally to methods and apparatus for positioning control devices near a bed, and more particularly to methods and apparatus for positioning electrical control devices proximate to a side rail of a bed.

BACKGROUND OF THE INVENTION

Many situations arise in which individuals are confined to bed for extended periods of time. for example, hospital patients are confined to bed while undergoing traction or following an operation. Also, nursing home residents are often bedridden as a consequence of their age, or rather, ill effects associated with the aging process. Such confinement might even be necessary in one's own home if medical treatment is being administered there.

In such situations, the bedridden individual often needs or wants to have ready access to an electrical device of some type, and the present invention is directed to this problem.

A television control device is one type of electrical device that the bedridden individual might want. Television control devices are well known, and usually include an on/off switch, loudspeaker, volume control and channel selector. Television control devices, and electrical devices in general, typically include an electrical cord and a body which houses the various components of the device, although remote control devices which lack a cord are becoming increasingly commonplace.

A call button is another electrical device that is usually advisable for a bedridden individual. Call buttons, alternatively called bell cords or attendent buttons, are typically pushbutton electrical switches which are electrically connected to an indicator at a nurses' station. If the bedridden individual is in need of something, the call button can be engaged to summon a medical attendant.

Call buttons, like television control devices, typically include an electrical cord and a body which houses the on/off switch. It is perceived that call buttons, like some television controls, could be completely untethered, however.

Bedridden people might need or want ready access to other electrical devices, and the present invention contemplates these other devices. However, for the sake of brevity, television control devices and call buttons are focused upon. Those skilled in the art will recognize that the present invention is not limited to television controls and call buttons.

Several methods and apparatus have been applied to the problem of positioning electrical devices within the reach of bedridden individuals. The rather obvious method of simply placing the device on the mattress or frame of the bed suffers from a major shortcoming. The device tends to fall off of the bed to the floor, and the result is that the device cannot be reached by the individual and the body or cord of the device is oftentimes damaged by the impact with the floor. Furthermore, even if the device remains on the bed, it is perceived that it then interferes with the comfort and safety of the bedridden individual.

Another similar technique involves pinning or clipping the electrical device to the bedclothes. It is perceived that this results in unneeded wear and tear on the bedclothes. Also, the device potentially interferes with the comfort of the individuals if it is pinned or clipped to the bedclothes. Finally, the bedclothes cannot be readily changed with the electrical device pinned to them.

Still another technique involves wrapping the cord of the electrical device around a side rail of the bed. The side rail is a rail structure that is typically slidably engaged with the bed frame. The side rail is typically made up of substantially vertical elongate members and substantially horizontal elongate members, and the side rail can usually be raised to provide a secure environment for the patient and lowered if unneeded or to permit the ingress or egress of the patient. Very often the vertical members act as vertical sliding surfaces and are supplied with mechanical detents which interact with receiving means attached to the bedframe. The detents provide for the lowered and raised positions of the side rail.

On its face, wrapping the cord of the electrical device about the side rail presents certain advantages over the methods discussed above. The electrical device is relatively secure and is not likely to fall to the floor. Also, it is relatively easy for the bedridden individual to reach the device. On the other hand, electrical cords are typically not designed to be tied into knots. Mechanical fatigue can result in damage to the cord, perhaps contributing to a hazardous situation.

U.S. Pat. No. 2,913,740, issued to C. D. Eldridge, shows a call button holder which attaches to the frame of a bed. The device accepts and frictionally constrains the cord of a call button. That is, the body of the device is not held in position. However, as noted above, the electrical cords of most devices are generally not designed to function as mechanical loadbearing components. Furthermore, this type of call button holder positions the button on the mattress of the bed, thereby potentially hindering the bed's occupant. The body of the device is not securely held so as to accommodate one-handed operation by the occupant. Finally, another perceived shortcoming is that this type of device clamps to the bed's frame, contributing to awkward clamping and unclamping procedures.

U.S. Pat. No. 3,757,363, issued to Joseph E. Langlais shows another device holder which is suitable for use with a bed. This type of holder also clamps to the frame of a bed, but, in contrast to the call button holder discussed immediately above, it is suitable for engaging the body of a call button, not the electrical cord. A long, slender flexible arm attached to the frame clamp has at its other end a bracket lined with a resilient material suitable for accepting the body of a call button. As mentioned above, clamping to the frame of the bed can be awkward. Furthermore, it is perceived that the slender arm is subject to being accidentally jarred and bent. The length and flexibility of the arm substantially preclude a sufficiently secure holding of the call button for one-handed operation of the button.

Additionally, U.S. Pat. No. 3,009,676, issued to W. G. Buchwald, shows another device which attaches to the frame of a bed. This device receives an electrical blanket control.

Although the techniques and devices discussed above may have some useful qualities, clearly they possess shortcomings. The present invention is directed to those shortcomings. More specifically, the present invention is a method and apparatus for securely holding an electrical device proximate to the side rail of a bed. Use of the present invention thus effectively prevents the electrical device from falling to the floor. Thus, the device is maintained within the bedridden individual's reach and impact with the floor is eliminated so as to prevent damage to the device.

Also, use of the present invention eliminates the need for pinning or clipping of a device to the bedclothes of the bed.

Additionally, the present invention provides for engagement of the body of the electrical device so as to not damage the cord of the device.

The present invention does not require that clamps or brackets be attached to the frame of the bed, including the bed rail. When the present invention is utilized, the electrical device is secure and easily reached by the bedridden individual.

SUMMARY OF THE INVENTION

Accordingly, the present invention includes an apparatus for holding a first electrical device having a first device body, the apparatus being suitable for operatively engaging a side rail of a bed, comprising: first means for receiving the first device body; and means operatively connected to the first receiving means for operatively engaging the side rail of the bed, wherein the first device body is held in position proximate to the side rail of the bed.

The electrical device mentioned above, in one embodiment, includes a control device of some type. Furthermore, the control device can include a television control device.

Alternatively, the first electrical device includes a call or attendant button. Or, the first electrical device includes a control device of some type and a call button.

In one embodiment, the engaging means includes a first slender member configured in a first shape suitable for hanging on the side rail of the bed. Also, the receiving means can include a second slender member configured in a second shape suitable for receiving the first device body. The slender members, in a preferred embodiment, include inner bent metal wire coated with an outer resilient material.

The invention also includes an apparatus for holding a first electrical device having a first device body and a second electrical device having a second device body, the apparatus being suitable for operatively engaging a side rail of a bed, including: first means for receiving the first device body; second means for receiving the second device body; and means operatively connected to the first and second receiving means for operatively engaging the side rail of the bed, wherein the first and second device bodies are held in position proximate to the side rail of the bed.

As mentioned above, the electrical devices include control devices and control buttons. Furthermore, the receiving means and engaging means can include slender members configured in the appropriate shapes. And, the slender members preferably include inner bent metal wire coated with thin outer resilient material.

In a narrower sense, the present invention includes an apparatus suitable for hanging on a substantially horizontal member of a side rail of a bed. The apparatus is suitable for holding a first electrical device having a first device body and a cord. The apparatus includes a basket suitable for receiving the first device body wherein the basket includes a first bent metal wire configured in an appropriate shape. the wire forms a cord aperture for accommodating the cord of the electrical device.

This embodiment also includes a first rail clip which is connected to the basket, the rail clip being suitable for hanging on the substantially horizontal member of the side rail. Preferably, the first rail clip also includes a bent metal wire appropriately shaped.

Furthermore, this embodiment includes a resilient outer layer coated on the basket and rail clip.

Another apparatus of the present invention includes first and second baskets suitable for receiving first and second electrical devices. The devices are preferably made of first and second bent metal wires which have been appropriately shaped and coated with a resilient outer layer. This embodiment also includes a rail clip which is connected to the first basket, the rail clip being formed from bent metal wire and coated.

Still another embodiment includes a second rail clip or the like, suitable for engaging a substantially vertical member of a side rail of a bed. The second rail clip serves to vertically stabilize the apparatus.

Another apparatus is directed to a circle bed. The circle bed also includes a side rail and the apparatus of the present invention preferably hangs on the side rail. The apparatus includes a second rail clip which comprises a bent metal wire configured in a shape suitable for engaging a member of the side rail to vertically stabilize the apparatus of the present invention and the electrical devices held thereby.

The present invention also includes a method for holding a first body of a first electrical device proximate to a side rail of a bed. The method includes receiving the first body with a first basket, the first basket conforming to the first body; securely holding the first body with the first basket; and hanging the first basket on the side rail, wherein the first body is securely held proximate to the side rail of the bed.

The method preferably includes receiving first and second bodies of first and second electrical devices and securely holding the first and second bodies so that they are proximate to the side rail of the bed. Preferably, the method is directed to holding a television control device and a call button.

The present invention also includes apparatus for holding electrical device bodies being formed from flat metal elements. Preferably the elements are made of cold-rolled mild steel and are coded with a resilient material, e.g., vinyl.

BRIEF DESCRIPTION OF THE DRAWINGS

FIG. 4 shows a perspective view of an apparatus which is a second embodiment of the present invention, the apparatus hanging on a side rail of a circle bed.

FIG. 5 shows a side elevational view of a bed, showing the side rail of the bed and the apparatus of FIG. 1 hanging on the side rail with a television control device and call button in place.

DETAILED DESCRIPTION OF THE INVENTION

The following is a detailed description of preferred embodiments of the present invention. It is understood by those skilled in the art that the present invention is not limited to the embodiments described below.

Figure 1:
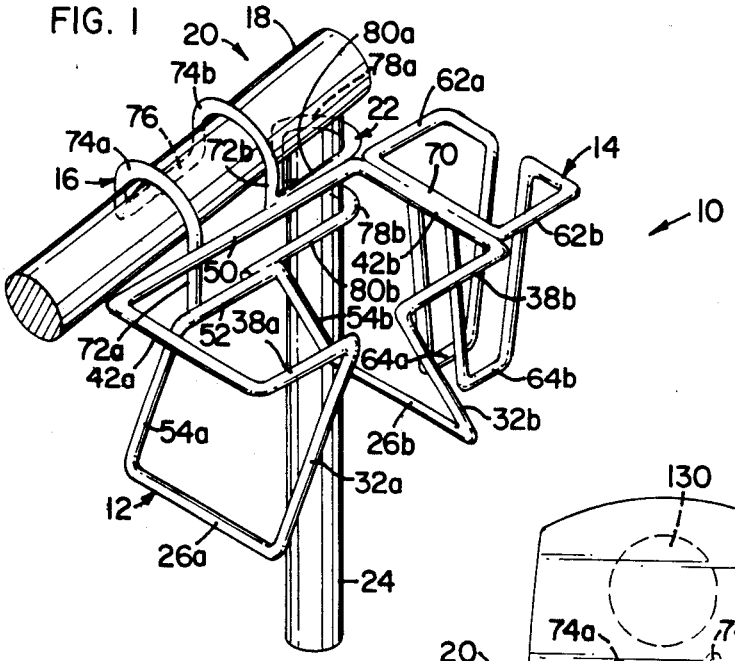
FIG. 1 shows a perspective view of a first embodiment of an electrical device holding apparatus of the present invention hanging on a side rail.

In the accompanying drawing, wherein like reference numerals represent like parts throughout the several views, FIG. 1 shows a perspective view of an apparatus 10, a first embodiment of the present invention. The apparatus 10, a bracket for holding a television control device 36 and call button 60 (shown in FIGS. 2 and 3) proximate to a side rail 20 of a bed 100 (see FIG. 5), preferably includes a television control basket 12 and a call button basket 14. The baskets 12 and 14 are shaped so as to receive the television control device 36 and call button 60, respectively.

A horizontal rail clip 16, connected to the basket 12 as described below, is shaped so as to hang on a substantially horizontal member 18 of the side rail 20 of the bed 100. It should be noted that the substantially horizontal as well known to those skilled in the art. Some side rails include rail members which angle slightly from the horizontal even when the bed is adjusted so as to be generally horizontal. And, the head portions of many beds are angularly adjustable, resulting in rai members which are substantially angled from the horizontal. However, for the sake of brevity, the rail 20 will be discussed as having a horizontal member 18 and vertical members 24.

Figure 2:
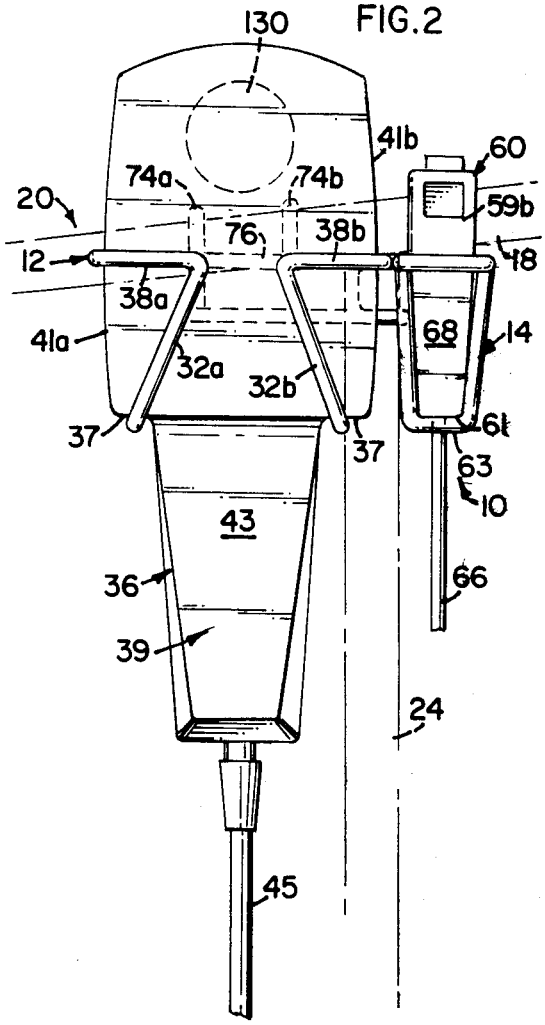
FIG. 2 shows a front elevational view of the apparatus of FIG. 1 with a television control device and call button in place.
Figure 3:
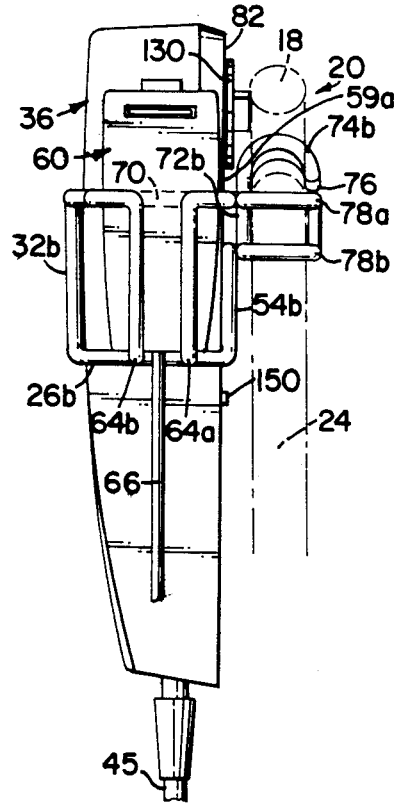
FIG. 3 shows a side elevational view of the apparatus of FIG. 1 with a television control device and call button in place.

In the preferred embodiment shown in FIGS. 1–3, the apparatus 10 further includes a vertical rail clip 22 which is connected to the television control basket 12 and is shaped so as to engage the vertical member 24 of the side rail 20. Thus, the apparatus 10 is securely engaged with the members 18 and 24 of side rail 20 as further described below. In this first embodiment the baskets 12 and 14 and rail clips 16 and 22 are preferably formed from metal wire or rod which has been bent using conventional forming techniques. One-eighth inch bright basic steel wire is the preferred material due to the ease with which it is formed and the ease by which the various components of the apparatus 10 are interconnected.

Preferably, for this embodiment, a single piece of wire is bent to form the television control basket 12. The wire which comprises basket 12 is shaped so as to receive the television control device 36, the device 36 including an on/off switch, volume control, loudspeaker, and channel selector for a remotely positioned television. The basket 12 is formed to include left and right lower support struts 26*a* and 26*b* which support lower ledges 37 of the device 36 as shown in FIG. 2. The lower support struts 26 are preferably substantially coplanar with the imaginary plane which includes the struts 26 being substantially perpendicular to the vertical member 24 when the apparatus 10 is engaged with the side rail 20. Again, the struts 26 preferably run fore and aft to support ledges 37 of the television control device 36 as shown in FIG. 2.

Running diagonally upward and inward from the lower struts 26*a* and 26*b* are front diagonal members 32*a* and 32*b*, respectively. That is, left front diagonal member 32*a* is connected to the left strut 26*a* and right member 32*b* is connected to the right strut 26*b*. The diagonal members 32 embrace the front 39 of the television control device 36 as shown in FIG. 2.

As noted above, in this embodiment the diagonal members 32 and the struts 26 are preferably formed from a single wire which has been appropriately bent using standard wire bending techniques.

Extending outwardly from the diagonal members 32*a* and 32*b* are substantially horizontal upper front members 38*a* and 38*b*, respectively. Preferably the upper front members 38 are integral with the diagonal members 32.

Above and substantially parallel to the lower support struts 26*a* and 26*b* are upper support struts 42*a l and 42b*, respectively. The uppers truts 42 run fore and aft as did the lower struts 26 and the upper struts 42 serve to engage the central portions of side panels 41 of the control device 36, as shown in FIG. 2.

The upper struts 42 are interconnected by a substantially horizontal upper back member 50. Similarly, a substantially horizontal lower back member 52 interconnects rear diagonal members 54*a* and 54*b* which are connected to struts 26*a* and 26*b*, respectively, and are substantially parallel to front diagronal members 32*a* and 32*b*, respectively.

Thus, in this first preferred embodiment the television control basket 12 is preferably formed from a single piece of steel wire which has been bent into a shape suitable to support and securely hold the television control device 36. The various components of the basket 12 are preferably integral with the ends of the wire being butt welded so that the wire forms a continuous slender member.

It can be seen that the basket 12 receives and supports body 43 of device 36, with cord 45 not being subjected to the stress and strain associated with holding the device 36 in position. That is, the cord 45 functions primarily as an electrical signal flow path, not as a mechanical load bearing member.

The call button basket 14 is also preferably formed from a single pice of one-eighth inch steel wire in the first embodiment. The wire is bent into a shape suitable for supporting the call button 60 as shown in FIGS. 2 and 3. The call button basket 14 includes upper struts 62 and lower struts 64 which serve similar functions to upper struts 42 and lower struts 26 of the basket 12. That is, the upper struts 62*a* and 62*b* engage sides 59*a* and 59*b* of the call button 60 substantially in the middle of the call button 60 and the lower struts 64 support underside 61 of the call button 60. The lower struts 64 also form an aperture 63 which admits a cord 66 of the call button 60. The call button 60 includes a body 68 and the cord 66. The body 68 is received and held by the call button basket 14 whereas the cord 66 is allowed to pass through the aperture 63 formed by the lower struts 64.

The call button basket 14 is preferably attached to the television control basket 12. An upper cross member 70 interconnects the upper struts 62*a* and 62*b*, and the member 70 is connected to the upper support strut 42*b* of the television control basket 12. Preferably, the baskets 12 and 14 of the first embodiment of the present invention are made of mild steel wire and are spot welded together. However, as well known to those skilled in the art, the baskets 12 and 14 can be formed from other materials and can be interconnected in various ways. Or, for that matter, the baskets 12 and 14 could be integral portions of a single piece of material.

The baskets 12 and 14 are engaged with the side rail 20 through the use of the rail clips 16 and 22. The horizontal rail clip 16 is made up of risers 72*a* and 72*b* which are connected to the television control basket 12. The risers 72*a* and 72*b* are also connected to upper hooks 74*a* and 74*b* which are appropriately shaped to conform to the substantially horizontal rail member 18. Finally, the horizontal hooks 74*a* and 74*b* are interconnected by an upper hook cross piece 76. Preferably, as was the case for the baskets 12 and 14, the horizontal rail clip 16 of the first embodiment of the invention is made up of a single piece of mild steel wire which has been bent into the appropriate shape using standard forming techniques. The rail clip 16, once it has been bent into the appropriate shape, is connected to the control basket 12 using conventional techniques, preferably welding.

As shown in FIGS. 2 and 3, the horizontal rail member 18 may in fact be slightly angled from the horizontal.

Thus, in order that the television control device 36 and call button 60 hang in substantially vertical orientations, the horizontal rail clip 16 must be angled with respect to the baskets 12 and 14 as shown in FIG. 2. That is, as shown in FIG. 2, the right horizontal hook 74*b* is preferably higher than the left hook 74*a* so as to accommodate a somewhat slanted rail member 18.

Of course, the precise nature of the rail clip 16 depends on the nature and configuration of the side rail 20. The present invention is not limited to any particular king or shape of side rail as is clear to those skilled in the art.

The apparatus 10 also includes, in this preferred embodiment, a vertical rail clip 22. The rail clip 22 is used to engage the vertical rail member 24 to vertically stablize the apparatus 10. The vertical rail clip 22 includes hooks 78*a* and 78*b* which are shaped to engage the rail member 24. The hooks 78*a* and 78*b* are connected to the television control basket 12 through the use of extenders 80*a* and 80*b* which are preferably welded to the basket 12 at the upper back member 50 and lower back member 52, respectively. Again, the vertical rail clip 22 may not be needed in some embodiments, and particularly may not be needed if the substantially horizontal rail member 18 has a rectangular configuration. Also, if the vertical rail member 24 has a shape other than as shown in the drawing, the rail clip 22 will have other shapes and configurations. The vertical rail clip 22 of the first embodiment of the invention is also preferably made of a mild steel wire which has been appropriately formed. Subsequent to the forming operation, the rail clip 22 is welded to the basket 12 so as to substantially complete the apparatus 10.

Following the assembly of the rail clips 16 and 18 and baskets 12 and 14, the entire assembly is preferably dipped in a coating solution. The solution applies a resilient coating on the various components of the apparatus 10 so that the apparatus 10 is less like to damage the side rail 20 or the control devices 36 and 60. A vinyl coating is preferred, though other resilient coatings are contemplated. Such a coating is also beneficial in that it electrically isolates the control device from the bed frame to minimize the patient's risk of electrical shock. A vinyl coating substance sold by P.D.I. Inc. of Roseville, Minn. under the trademark "PLASTI-DIP" has been found to be a particularly good electrical insulator. "PLASTI-DIP" coating material has a dielectric strength of 300 volts per mil. Approximately a 47 mil thick layer of "PLASTI-DIP" coating material is preferably applied using conventional dipping techniques. It should also be noted that the "PLASTI-DIP" material is autoclave safe.

FIG. 2 shows a front elevational view of the apparatus 10 with devices 36 and 60 in place. As shown in FIG. 2, the apparatus 10 acts to engage the bodies 43 and 68 of the devices to securely hold the devices 36 and 60 and to minimize undue mechanical stress on the cords 45 and 66 of the devices 36 and 60. Clearly, depending on the precise shapes of the bodies of the devices, the baskets 12 and 14 may have to be altered. In fact, one type of television control device includes a call button as one of its components. In this type of device, the call button basket 14 is not necessary.

FIG. 3 shows a side elevational view of the apparatus 10 with the electrical devices 60 and 36 in place. It should be noted that the devices 60 and 36 are held adjacent to or, generally, proximate to the side rail 20 of the bed 100 (see FIG. 5). The preferred location of the apparatus 10 is on the outside of side rail 20. FIG. 5 clearly illustrates the preferred use of apparatus 10. When the apparatus 10 is located on the outside of rail 20 the rail 20 can be lowered (for example, when changing the bedclothes or to admit the bed's occupant) without having to remove the apparatus 10 or the devices 36 and 60. The television control device 36 has a control knob 130 and volume control knob 150 which apparatus 10 holds in an accessible position above the horizontal rail 18. Thus, the devices 36 and 60 are easily reached and manipulated by the bed's occupant.

In FIG. 3, the front of the device 36 is generally designated with the preference numeral 82. As noted above, it is preferable to have the front 82 of the device 36 facing the bed's occupant. Further, the apparatus 10 is preferably on the outside of the side rail 20 for easy access by the bedridden individual and to accomodate lowering of the rail 20. This is also shown in FIG. 5.

FIG. 5 illustrates the apparatus 10 of FIG. 1 in operation on the side rail 20. The bed 100 includes a mattress 102 and a bed frame 104. Attached to the frame 104, toward the head of the bed, are a pair of receiving members 106. Members 106 are typically rigidly attached to the frame 104 of the bed and are in the nature of hollow cylindrical members adapted to slidably receive the vertical side rail members 24. The vertical members 24 also preferably include springloaded detent members 108, the detent members interfering with the cylindrical members 106 to selectively hold the side rail 20 in a raised position as shown in FIG. 5.

It should be emphasized that the bed 100 as shown in FIG. 5 is only shown by way of example and the present invention is not limited to any particular type of bed. The conventional bed shown in the Figures is provided by Hill-Rom Corporation of Batesville, Ind., a subsidiary of Batesville Corporation. An apparatus of the present invention can be used in conjunction with any bed side rail and the present invention contemplates various types of beds and side rails.

FIG. 4 shows an apparatus 10' which represents a second embodiment of the apparatus of the present invention. The use of the "prime" symbol in conjunction with the various reference numerals indicates that many, but not all, of the components of the apparatus 10' are substantially similar to the components of the apparatus 10. For example, the apparatus 10' preferably includes a television control basket 12' and a call button basket 14'. Furthermore, the apparatus 10' includes a horizontal rail clip 16'.

Figure 8:
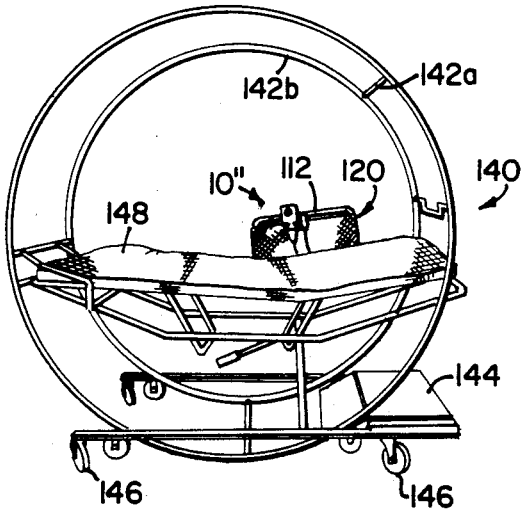
FIG. 8 shows a perspective view of a circle bed having an upright side rail supporting the embodiment of FIG. 6 which in turn is holding a television control device and a nurse call button.

The apparatus 10' is specifically designed for a circle bed 140, shown in FIG. 8. The circle bed 140 includes large circular frame members 142 which form two large parallel circles. The frame of the bed also includes a substantially stationary portion 144 which includes rollers 146. The mattress 148 of the bed and its supporting framework attach to the large parallel circular rings and the bed can be rotated so that the patient can be placed on his stomach without having to manually raise the patient from the surface of the bed. The circle bed 140 also includes a side rail 120. Rail 120 has an upright position (shown in FIG. 8) and a flat position (not shown) in which it is substantially parallel with the mattress 148. As well known to those skilled in the art, the Stryker Corporation of Kalamazoo, Mich. sells such a circle bed 140 under the name Stryker 460 Circle.

FIG. 4 shows a portion of side rail 120. In an upright position, the side rail 120 functions in a fashion similar to the side rail 20 shown in FIG. 5. That is, the upright side rail 120 serves to safely maintain the bed's occupant on the mattress.

Figure 9:
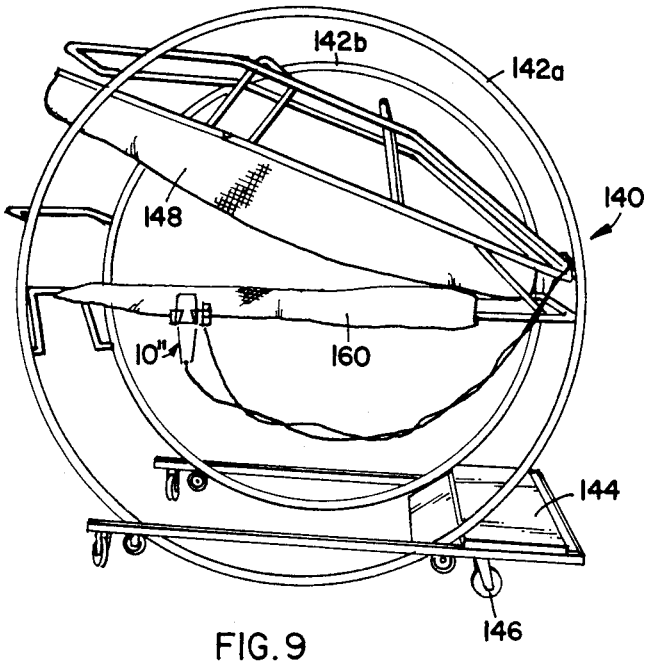
FIG. 9 shows a perspective view of a circle bed in the inverted position and also shows the stomach board in place.

In a reclined position, however, as well known to those skilled in the art, the side rail 120 of circle bed 140 functions as an arm rest for use when the patient is on his stomach. In this reclined position, the side rail 120 as a whole is substantially horizontal to provide a supporting surface for the arms of the patient. FIG. 9 shows a circle bed 140 with its stomach board 160 in position. The side rail 120 extends in parallel fashion away from board 160, and device 10'' hangs from side rail 120.

FIG. 4 illustrates a first rail member 112 and a second rail member 114 which are components of the side rail 120 of circle bed 140.

Referring to FIG. 4, a hook 110, attached to the rail hook 16', conforms to the rail member 114 to prevent twisting of the apparatus 10' when the electrical devices are in place. The hook 110 is preferably made of mild steel wire and is welded to the rail clip 16' prior to dipping the entire apparatus 10' to provide a resilient coating as described above.

Figure 6:
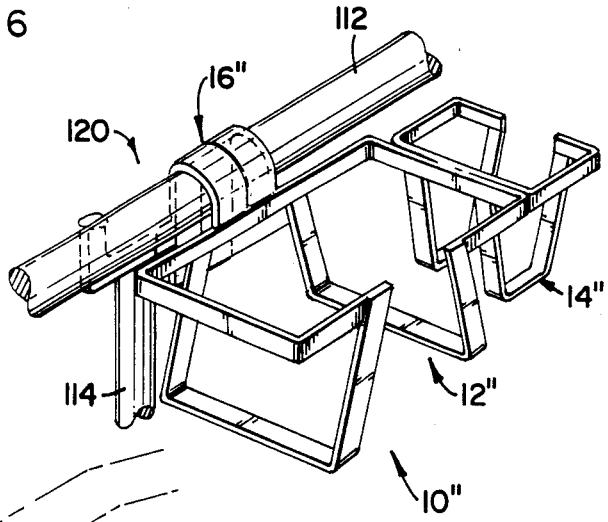
FIG. 6 shows a perspective view of a third embodiment of the present invention hanging on an upright side rail of a circle bed.

It should be noted that the apparatus 10' can also be used with the side rail 120 of a circle bed when the side rail is in its upright orientation, rotated 90 degrees from the orientation shown in FIG. 4. FIG. 6, for example, shows the side rail 120 in the upright position. FIG. 6 also shows a third embodiment 10'' of the present invention. The device 10'' is visually similar to the second embodiment 10'shown in FIG. 4. It includes a television control basket 12'' similar to the basket 12', a call button basket 14'' similar to the call button bsket 14', and a rail clip 16'' similar to the rail clip 16'. In fact, the hanging apparatus 10'' is structurally virtually identical to the apparatus 10' except that is is made from flat metal, not wire. $1/16 \times \frac{3}{8}$ inch mild CR steel is preferably used to fabricate the baskets 12'' and 14'' while $3/32 \times \frac{1}{2}$ inch mild CR steel is preferably used for the rail clip 16''.

Figure 7:
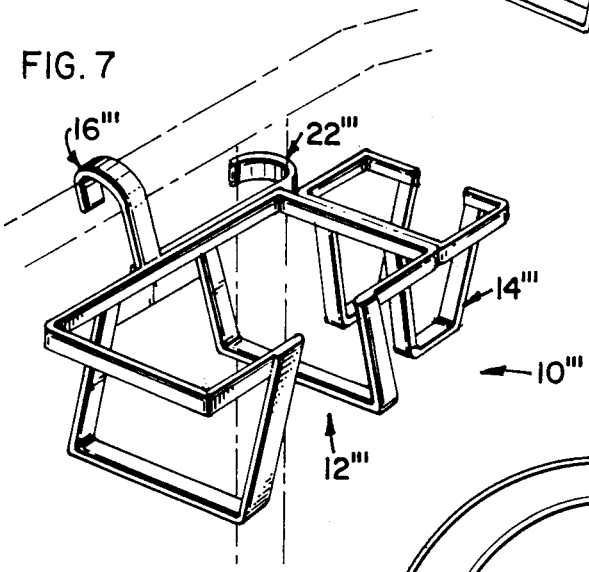
FIG. 7 shows a perspective view of a fourth embodiment of the present invention hanging on the side rail of a conventional bed.

In like manner, FIG. 7 shows a fourth embodiment 10''' which is dimensionally identical to the first embodiment 10. The device 10''' includes a televison rail clip 16'''.

The devices 10'' and 10''', shown in FIGS. 6 and 7, respectively, are preferably fabricated using conventional spot welding techniques and coated with "PLASTI-DIP" vinyl coating or the like.

It should be emphasized that the present invention is not limited to any particular materials or methods. That is, the apparatus of the present invention could be formed from plastic or other materials, and is not limited to fabrication from one-eighth inch steel wire or flat metal strap.

Furthermore, the apparatus 10, 10', 10'', and 10'''need not necessarily be coated with a resilient material as they are in the preferred embodiments discussed above. Also, the invention is not limited to the particular electrical devices discussed above. Other types of electrical devices could be held by similar apparatus and still fall within the boundaries of the present invention.

Numerous characteristics and advantages among inventions have been set forth in the foregiong detailed description. It will be understood, of course that this disclosure is, in many respects, only illustrative. Changes may be made in details, particularly in matters of shape, size, and arrangement of parts without exceeding the scope of the invention. The scope of the invention is defined in the language in which the appended claims are expressed.

I claim:

1. An apparatus suitable for hanging on a substantially horizontal member of a side rail of a bed for holding a television controller having a television controller body and a television controller cord and a call button having a call button body and a call button cord, comprising:

(a) a first basket suitable for receiving the television controller body, said first basket including a first bent metal wire configured in a first shape substantially conforming to the television controller body, said first shape forming a first cord aperture for accommodating the television controller cord;

(b) a second basket connected to said first basket suitable for receiving the call button body, said second basket including a second bent metal wire configured in a second shape substantially conforming to the call button body, said second shape forming a second cord aperture for accommodating the call button cord;

(c) a first rail clip connected to said first basket suitable for hanging on the substantially horizontal member of the side rail, said first rail clip including a third bent metal wire configured in a third shape substantially conforming to the substantially horizontal member of the side rail; and (d) a resilient outer layer coated on said baskets and said first rail clip, wherein the television controller and call button are held in position proximate to the side rail of the bed, wherein the side rail includes a substantially vertical member connected to the substantially horizontal member, and wherein the apparatus further comprises a second rail clip connected to said first rail clip suitable for engaging the substantially vertical member, said second rail clip including a fourth bent metal wire configured in a fourth shape substantially conforming to the substantially vertical member of the side rail, and said resilient outer layer is coated on said second rail clip.

2. An apparatus suitable for hanging ona substantially horizontal member of a side rail of a bed for holding a television controller having a television controller body and a television controller cord and a call button having a call button body and a call button cord, comprising:

(a) a first basket suitable for receiving the television controller body, said first basket including a first bent metal wire configured in a first shape substantially conforming to the television controller body, said first shape forming a first cord aperture for accommodating the television controller cord;

(b) a second basket connected to said first basket suitable for receiving the call button body, said second basket including a second bent metal wire configured in a second shape substantially conforming to the call button body, said second shape forming a second cord aperture for accommodating the call button cord;

(c) a first rail clip connected to said first basket suitable for hanging on the substantially horizontal member of the side rail, said first rail clip including a third bent metal wire configured in a third shape substantially conforming to the substantially horizontal member of the side rail; and (d) a resilient outer layer coated on said baskets and said first rail clip, wherein the television controller and call button are held in position proximate to the side rail of the bed, wherein the bed is a circle bed and the side rail is of the twoposition type, wherein in an upright position the side rail includes a substantially horizontal first member having a substantially circular cross section and a substantially vertical second member connected to the first member having a substantially rectangular cross section, and wherein the apparatus further comprises a second rail clip connected to said first rail clip suitable for engaging the second member, said second rail clip including a fourth bent metal wire configured in a fourth shape substantially conforming to the second member of the side rail, and said resilient outer layer is coated on said second rail clip.

3. An apparatus suitable for hanging on a substantially horizontal member of a side rail of a bed for holding a first electrical device having a first device body and a first cord and a second electrical device having a second device body and a second cord, comprising:

(a) a first basket suitable for receiving the first device body, said first basket including a first bent flat metal element configured in a first shape substantially conforming to the first device body, said first shape forming a first cord aperture for accommodating the first cord;

(b) a second basket connected to said first basket suitable for receiving the second device body, said second basket including a second bent flat metal element configured in a second shape substantially conforming to the second device body, said second shape forming a second cord aperture for accommodating the second cord;

(c) a first rail clip connected to said first basket suitable for hanging on the substantially horizontal member of the side rail, said first rail clip including a third bent flat metal element configured in a third shape substantially conforming to the substantially horizontal member of the side rail; and (d) a resilient outer layer coated on said baskets and said first rail clip, wherein the first and second device bodies are held in position proximate to the side rail of the bed, wherein the side rail includes a substantially vertical member connected to the substantially horizontal member, and wherein the apparatus further comprises a second rail clip connected to said first rail clip suitable for engaging the substantially vertical member, said second rail clip including a fourth bent flat metal element configured in a fourth shape substantially conforming to the substantially vertical member of the side rail, and said resilient outer layer is coated on said second rail clip.

4. An apparatus suitable for hanging on a substantially horizontal member of a side rail of a bed for holding a first electrical device having a first device body and a first cord and a second electrical device having a second device body and a second cord, comprising:

(a) a first basket suitable for receiving the first device body, said first basket including a first bent flat metal element configured in a first shape substantially conforming to the first device body, said first shape forming a first cord aperture for accommodating the first cord;

(b) a second basket connected to said first basket suitable for receiving the second device body, said second basket including a second bent flat metal element configured in a second shape substantially conforming to the second device body, said second shape forming a second cord aperture for accommodating the second cord;

(c) a first rail clip connected to said first basket suitable for hanging on the substantially horizontal member of the side rail, said first rail clip including a third bent flat metal element configured in a third shape substantially conforming to the substantially horizontal member of the side rail; and (d) a resilient outer layer coated on said baskets and said first rail clip, wherein the first and second device bodies are held in position proximate to the side rail of the bed, wherein the bed is a circle bed and the side rail is of the twoposition type, wherein in an upright position the side rail includes a substantially horizontal first member having a substantially circular cross section and a substantially vertical second member connected to the first member having a substantially rectangular cross section, and wherein the apparatus further comprises a second rail clip connected to said first rail clip suitable for engaging the second member, said second rail clip including a fourth bent flat metal element configured in a fourth shape substantially conforming to the second member of the side rail, and said resilient outer layer is coated on said second rail clip.

5. An apparatus suitable for hanging on a side rail of a bed for holding an electrical device having a body and a cord, wherein the side rail comprises a substantially horizontal member and a substantially vertical member, the apparatus comprising:

(a) a basket suitable for receiving the electrical device body, the basket comprising a first bent metal element configured to conform to the device body, and the basket forming a cord aperture for accommodating the electrical device cord;

(b) a first rail clip connected to the basket suitable for hanging on the horizontal member of the side rail, the first rail clip comprising a second bent metal element configured in a shape substantially conforming to the horizontal member of the side rail;

(c) a second rail clip connected to the first rail clip suitable for engaging the vertical member of the side rail, the second rail clip comprising a third bent metal element configured in a shape substantially conforming to the vertical member of the side rail; and (d) a resilient outer layer coated on the basket and the rail clips, wherein the electrical device is held in position proximater to the side rail of the bed.

6. An apparatus suitable for hanging on a side rail of a circle bed for holding an electrical device having a body and a cord, the side rail being of the two-position type, wherein in an upright position the side rail comprises a substantially horizontal member having a substantially circular cross section and a substantially vertical member connected to the horizontal member having a substantially rectangular cross section, the apparatus comprising:

(a) a basket suitable for receiving the electrical device body, the basket comprising a first bent metal element configured to conform to the device body, and the basket forming a cord aperture for accommodating the electrical device cord;

(b) a first rail clip connected to the basket suitable for hanging on the horizontal member of the side rail, the first rail clip comprising a second bent metal element configured in a shape substantially conforming to the horizontal member of the side rail;

(c) a second rail clip connected to the first rail clip suitable for engaging the vertical member of the side rail, the second rail clip comprising a third bent metal element configured in a shape substantially conforming to the vertical member of the side rail; and (d) a resilient outer layer coated on the basket and the rail clips, wherein the electrical device is held in position proximate to the side rail of the bed.

* * * * *